US007589268B2

(12) United States Patent
Keefe et al.

(10) Patent No.: US 7,589,268 B2
(45) Date of Patent: Sep. 15, 2009

(54) CONICAL PICCOLO

(76) Inventors: James J. Keefe, 64 Church St., Winchester, MA (US) 01890; Janet D. Kinmouth, 33 Page Brook Rd., Carlisle, MA (US) 01741

( * ) Notice: Subject to any disclaimer, the term of this patent is extended or adjusted under 35 U.S.C. 154(b) by 0 days.

(21) Appl. No.: 12/070,700

(22) Filed: Feb. 21, 2008

(65) Prior Publication Data

US 2008/0302229 A1 Dec. 11, 2008

Related U.S. Application Data

(63) Continuation-in-part of application No. 11/501,344, filed on Aug. 9, 2006, now Pat. No. 7,394,007.

(51) Int. Cl.
*G10D 7/02* (2006.01)

(52) U.S. Cl. ..... 84/384

(58) Field of Classification Search ..... 84/380 R, 84/384

See application file for complete search history.

(56) References Cited

U.S. PATENT DOCUMENTS 6,259,010 B1 7/2001 Nagahara

*Primary Examiner*—Kimberly R Lockett
(74) *Attorney, Agent, or Firm*—Lambert & Associates; Gary E. Lambert

(57) ABSTRACT

The subject invention is an improved conical piccolo comprising various new fingering mechanisms and configurations, as well as an additional tone hole opening. The improved conical piccolo allows a user to easily play all six standard trills produced by the cylindrical flute fitted with the c sharp trill key, including the third octave G to A trill. Moreover, the improved conical piccolo simplifies the fingering required by a user to play the third octave G to A trill. Moreover, the subject invention allows the user of piccolo to play two additional trills, namely the first and second octave C to D trills, with improved intonation and response.

12 Claims, 14 Drawing Sheets

CONICAL PICCOLO

CROSS REFERENCE TO RELATED APPLICATION

This application is a continuation-in-part of prior U.S. application Ser. No. 11/501,344 filed on Aug. 9, 2006 now U.S. Pat. No. 7,394,007, the contents of which are incorporated herein by reference.

BACKGROUND OF THE INVENTION

1. Field of Invention

The invention relates generally to the field of conical piccolos and especially of an improved conical piccolo that simplifies the fingering required by a user to play the third octave G to A trill.

2. Description of the Related Art

Almost all modern orchestras and symphonic bands use conical piccolos. Some piccolo players do use the cylindrical piccolos, especially in marching bands, but in orchestras their use is rare. Conical piccolos, like cylindrical piccolos and flutes, can produce a sound known as trilling. The Harvard Dictionary of Music defines trilling as a musical ornament consisting of the rapid alternation of a given note with a diatonic second above it (Harvard Dictionary of Music, (1972), 2nd Edition, Willi Apel, Harvard University Press, Cambridge, Mass.). One limitation of the conical piccolo is the difficult and awkward fingering required to create an accurate and in-tune trill between the notes of G and A of the third, or highest, octave (the G/A trill). In the art, fingering is a term meaning a methodical pattern of usage of the fingers in playing an instrument (Harvard Dictionary of Music, (1972), 2nd Edition, Willi Apel, Harvard University Press, Cambridge, Mass.).

Conical piccolo fingering guides list multiple fingerings for the G/A trill, but all of them are difficult to implement. For example, Williams lists eight possible fingerings for the G/A trill on the conical piccolo (Williams, Morgan, (December 1997), "Piccolo Trill Fingerings," *Flute Talk*, pp. 31-32). Williams describes these eight fingerings as either awkward, difficult to play, or requiring a user to push in the head joint which means the user must stop playing and adjust the spacing between the head joint and body of the conical piccolo. By using this last method in place of utilizing prior methods, a user would have to: 1) stop playing the piccolo; 2) adjust the spacing; 3) play the G/A trill; 4) re-adjust the spacing; and 5) resume playing the piccolo.

Due to the nature of the acoustic difference between the cylindrical flute or cylindrical piccolo and the conical piccolo the third octave G/A trill becomes mechanically problematic. To produce the correct venting for the third octave A note in the G/A trill requires a very awkward fingering wherein the first finger of the left hand goes up, the fourth finger of the left hand goes down and the first finger of the right hand goes down simultaneously and in rapid succession.

Many fingerings of the conical piccolo can be played by adapting the fingerings used on a cylindrical flute. The G/A trill can be played easily on the cylindrical flute. The standard flute fingering for the third octave G/A trill works very well. However, this preferred flute fingering is not even listed in conical piccolo fingering guides because it does not work. While most of the fingerings used on the cylindrical bore flute work well on the conical piccolo, the fingering for the third octave G/A trill does not work.

On the cylindrical flute the third octave G/A trill is made easier for a user by the use of a special key, called the C sharp trill key, which consists of an additional tone hole opening and key. This C sharp trill key simplifies at least six trills on the flute by allowing a user to switch several left hand movements to the right hand. These six trills or standard trills are the first and second octave B to C sharp, the first and second octave C to C sharp, the third octave F sharp to G sharp, the third octave G to A flat, the third octave A flat to B flat and the third octave G to A. One of the trills simplified by this key is the third octave G/A trill. This C sharp trill key provides simpler fingering, improved tone quality, improved tuning of the pitches of the individual notes in the trills, and more dynamic range to the user. The C sharp trill key was patented in France in 1909 by Mme. Cornelie Villedieu Laube. (French patent No. 409,922).

Adapting the C sharp trill key found on cylindrical flutes to the conical piccolo allows a user to easily play five of the six main trills on the conical piccolo but it does not allow a user to produce the third octave G/A trill. Thus, even with the addition of a C sharp trill key to the conical piccolo, a user must still use an awkward or difficult fingering to produce the third octave G/A trill. Instead of using the C sharp trill key found on the flute, a few obscure conical piccolos and some, but more commonly, cylindrical flutes have been manufactured with a slightly different trill mechanism, usually called the G-A trill key.

The G-A trill key consists of two small tone hole openings: a C sharp tone hole opening and an A tone hole opening controlled by one key. However, the G-A trill key on the conical piccolo produces a third octave G/A trill that is unresponsive and can only be played at the loudest volumes possible and even then, it is very difficult for a user to sustain the sound. This G-A trill key on the conical bore piccolo does not produce a satisfactory third octave G/A trill on the conical piccolo and it is not an option offered by virtually any modern piccolo makers. This G-A trill key is also quite obscure on older conical piccolos.

In summary, the standard cylindrical flute fingering for the G/A trill is effective on the flute but is entirely ineffective on the conical piccolo. In addition, the C sharp trill key allows a user to easily play six main trills, including the G/A trill on a cylindrical flute, but a similar mechanism on a conical piccolo does not allow a user to produce a satisfactory G/A trill. Finally, on rare occasions, a G-A trill key is added to the conical piccolo and only works when played at the loudest volume possible and is therefore unsuitable for orchestral work which requires a versatile range of volume. Thus, no good solution to the problem of playing the third octave G/A trill on the conical piccolo existed before the subject invention.

Allowing users of conical piccolos to easily play the G/A trill is desired since this trill is regularly found in the orchestral repertoire. Several examples of pieces that employ this G/A trill include The Nutcracker Ballet by Tchaikovsky, Symphonic Metamorphosis by Hindemith and Cakewalk Suite by Gottschalk.

The subject invention provides at the very least three known improvements to currently existing conical piccolos. First, the subject invention provides an improved conical piccolo that allows a user to simply play the G/A trill. Second, this invention provides an improved conical piccolo with a C sharp trill mechanism that allows the user of the piccolo to easily play all six standard trills, including the G/A trill. Third, the subject invention allows the user of piccolo to play two additional trills, with improved intonation and response. These trills are the first and second octave c to d trills.

In a further embodiment, an instrument deemed the 158A design exists. Basically, there exist two key elements of design 158A. The first element comprises a configuration where the G sharp trill key drives the C sharp trill by means of a clutch. The second element comprises a configuration where the G sharp trill key opens the G sharp key by means of a link that is part of the G sharp trill key and a bar that is mounted on the G sharp key.

BRIEF SUMMARY OF THE INVENTION

The subject invention provides for an improved conical piccolo comprising an additional tone hole opening, an axle, a means for attaching the axle to the conical piccolo, wherein the axle further comprises an external cover of tubing; wherein the tubing rotates around the axle, a trill key attached at a first end to the tubing, a trill key pad attached to a second end of the trill key, a means for applying a first rotational force to the trill key wherein the trill key pad seals the additional tone hole opening, and a means for a user to apply a second rotational force wherein the trill key rotates on the tubing away from the additional tone opening wherein the trill key pad no longer seals the additional tone hole opening.

The instant invention further provides for an improved conical piccolo comprising an additional tone hole opening, a first post attached to the F sharp post, a second post attached to the upper C sharp post, an axle attached at a first end to the first post and attached at a second end to the second post. The axle further comprises an external cover of tubing and the tubing is disposed to rotate around the axle. Further included are a trill key attached at a first end to the tubing, a trill key pad attached to a second end of the trill key, a trill key tail attached at a first end to the tubing, a trill lever attached at a first end to the tubing proximal to the first post, a spring catch attached to the tubing and a wire spring attached at a first end to the second post and attached at a second end to the spring catch. The wire spring applies rotational force to the trill key and the spring catch in opposing directions wherein the trill key pad seals the additional tone hole opening. Thus, depressing a second end of the trill lever rotates the tubing around the axle and opposes the rotational force applied to the trill key wherein the trill key rotates on the tubing away from the additional tone hole opening wherein the trill key pad no longer seals the tone hole opening.

The subject invention provides at very least three known improvements to currently existing conical piccolos. First, the subject invention provides an improved conical piccolo that allows a user to simply play the G/A trill. Second, this invention provides an improved conical piccolo with a C sharp trill mechanism that allows the user of the piccolo to easily play all six standard trills, including the G/A trill. Third, the subject invention allows the user of piccolo to play two additional trills, with improved intonation and response. These trills are the first and second octave c to d trills.

In a further embodiment, an instrument deemed the 158A design exists. Basically, there exist two key elements of design 158A. The first element comprises a configuration where the G sharp trill key drives the C sharp trill by means of a clutch. The second element comprises a configuration where the G sharp trill key opens the G sharp key by means of a link that is part of the G sharp trill key and a bar that is mounted on the G sharp key.

It is an object of the instant invention to provide a method of using an improved conical piccolo which allows a user to simultaneously vent the C sharp trill tone hole opening, the D trill tone hole opening and the G sharp tone hole opening using the first two fingers of the right hand. It is also an object of the instant invention to provide an improved conical piccolo, wherein during a continuous play duration, a user can play all six standard trills of the flute by depressing keys of the piccolo.

It is an additional object of the instant invention to introduce an improved conical piccolo wherein a user can play the third octave, G to A trill by trilling fingers of one hand and in the same direction of motion. It is an object of the instant invention to illustrate an improved conical piccolo wherein the third octave G to A trill is improved in clarity, repetition and intonation.

Accordingly, an improved conical piccolo, accompanying enhancements and the component elements are herein described, which achieve these objectives, plus other advantages and enhancements. These improvements to the art will be apparent from the following description of the invention when considered in conjunction with the accompanying drawings wherein there has thus been outlined, rather broadly, the more important features of the improved conical piccolo in order that the detailed description thereof that follows may be better understood, and in order that the present contribution to the art may be better appreciated.

There are additional features of the invention that will be described hereinafter and which will form the subject matter of the claims appended hereto. In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of the description and should not be regarded as limiting.

These together with other objects of the invention, along with the various features of novelty, which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention. Other features and advantages of the present invention will become apparent from the following description of the preferred embodiment(s), taken in conjunction with the accompanying drawings, which illustrate, by way of example, the principles of the invention.

DETAILED DESCRIPTION OF THE INVENTION

Figure 1:
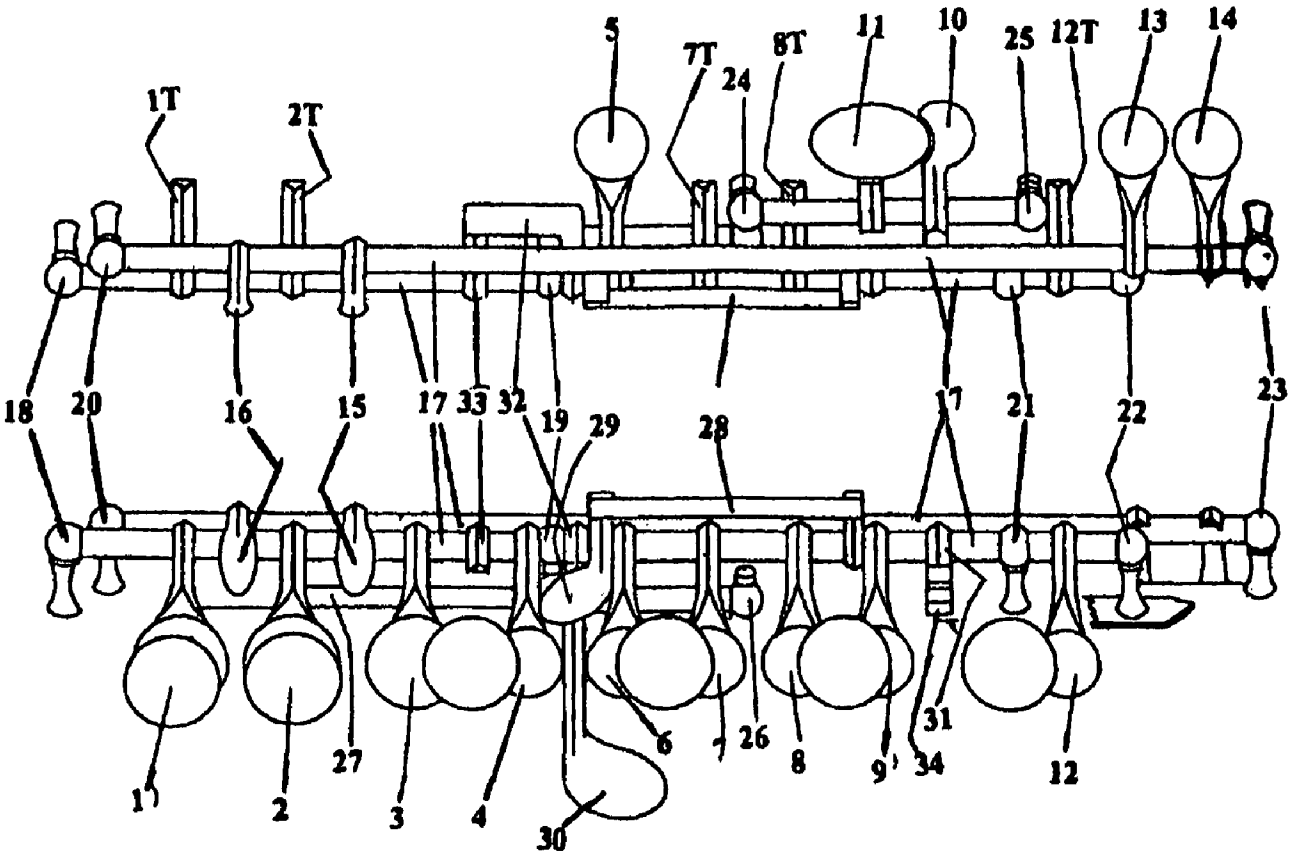
FIG. 1 is a top view of the standard conical piccolo mechanism.

In one embodiment, the instant invention introduces the correct venting for each note in the G/A trill on the conical piccolo, while not limiting the availability of any of the standard six trills found on the cylindrical flute C sharp trill. FIG. 1 illustrates the standard conical piccolo mechanism built by nearly all modern piccolo and flute makers, known as the Boehm system.

The standard conical piccolo mechanism includes a D key 1, a D key tail 1T, an E key 2, an E key tail 2T, an F key 3, an F sharp key 4, a G sharp key 5, a G key—lower cup 6, a G key—upper cup 7, a G key tail 7T, an A key 8, an A key tail 8T, an A sharp key 9, a Thumb B flat key 10, a Thumb B natural key 11, a C sharp key 12, a C sharp key tail 12T, a D trill key 13, a D sharp trill key 14, a D trill lever 15, a D sharp trill lever 16, tubing 17, a D post 18, an F sharp post 19, a Lower trill post 20, a Lower C sharp post 21, an Upper C sharp post 22, an upper trill post 23, a lower thumb post 24, an upper thumb post 25, a G sharp post 26, a Right hand bridge 27, a Left hand bridge 28, a B flat shake 29, a G sharp lever 30, a cam 31, a Left hand back connector 32, a Right hand back connector 33, and a B flat thumb tail 34. The D sharp key, which is also part of the standard conical piccolo mechanism, is not shown. This mechanism does not include the C sharp trill key or a G sharp trill key.

The improved conical piccolo of the subject invention is based upon the Boehm system, but with further improvements. Accordingly, since many variations exist for the production of a Boehm system conical piccolo, the improved conical piccolo of the subject invention incorporates all the embodiments for producing variations of Boehm system conical piccolos known in the art. For instance, the improved conical piccolo of the subject invention may be pitched in either the key of C, D flat, B Flat or any other key known in the art.

The improved conical piccolo of the subject invention may be a ring key piccolo or an open hole piccolo. In addition, the improved conical piccolo of the subject invention may be composed of any material known in the art including, but not limited to wood, composite materials such as fiberglass or carbon fiber, plastic, or metals such as gold, silver, platinum, nickel, tin and brass. The improved conical piccolo of the subject invention may be manufactured by hand, by machine, a combination of both or by any means known in the art.

The keys of the instant mechanism may be connected by pinning or soldering them to the axles or by attaching them to the axles with set screws. In the alternative, the keys may be connected by soldering them to bridges or metal rods that run parallel to the axles. All of the disclosed figures display keys connected by soldering them to bridges. However, the improved conical piccolo of the subject invention may have the keys pinned or soldered to the axles, or attached to the axles with set screws.

In addition, various types of tubing may be used in the improved conical piccolo of the subject invention, including mechanism tubing and hinge tubing. The subject invention encompasses an improved conical piccolo that allows a user to easily produce the third octave G/A trill without awkward and impractical fingering.

The subject invention provides for an improved conical piccolo comprising an additional tone hole opening, an axle, a means for attaching the axle to the conical piccolo, wherein the axle further comprises an external cover of tubing; wherein the tubing rotates around the axle, a trill key attached at a first end to the tubing, a trill key pad attached to a second end of the trill key, a means for applying a first rotational force to the trill key wherein the trill key pad seals the additional tone hole opening, and a means for a user to apply a second rotational force wherein the trill key rotates on the tubing away from the additional tone opening wherein the trill key pad no longer seals the additional tone hole opening.

The invention also provides for an improved conical piccolo comprising an additional tone hole opening, a first post attached to the F sharp post, a second post attached to the upper C sharp post, an axle attached at a first end to the first post and attached at a second end to the second post, wherein the axle further comprises an external cover of tubing, wherein the tubing rotates around the axle, a trill key attached at a first end to the tubing, a trill key pad attached to a second end of the trill key, a trill key tail attached at a first end to the tubing, a trill lever attached at a first end to the tubing proximal to the first post, a spring catch attached to the tubing, a wire spring attached at a first end to the second post and attached at a second end to the spring catch, wherein the wire spring applies rotational force to the trill key and the spring catch in opposing directions wherein the trill key pad seals the additional tone hole opening, wherein depressing a second end of the trill lever rotates the tubing around the axle and opposes the rotational force applied to the trill key wherein the trill key rotates on the tubing away from the additional tone hole opening wherein the trill key pad no longer seals the tone hole opening.

The improved conical piccolo may further comprise a trill touch piece mounted on the G sharp lever, wherein depressing the trill touch piece and the trill lever simultaneously unseals the additional tone hole opening and the G sharp key. The rotational force applied to the trill key in the improved conical piccolo of the subject invention may be applied by any means known in the art. Methods of applying this rotational force may include, but are not limited to needle springs, coil springs, opposing magnets or any other means known in the art.

The invention also provides for a method of using the improved conical piccolo which allows a user to simultaneously vent the C sharp trill tone hole opening, the D trill tone hole opening and the G sharp tone hole opening using the first two fingers of the right hand. The subject invention encompasses an improved conical piccolo, wherein during a continuous play duration, a user can play all six standard trills of the flute by depressing keys of the piccolo. The subject invention also encompasses an improved conical piccolo wherein a user can play the third octave, G to A trill by trilling fingers of one hand and in the same direction of motion. The subject invention also encompasses an improved conical piccolo wherein the third octave G to A trill is improved in clarity, repetition and intonation.

Figure 2:
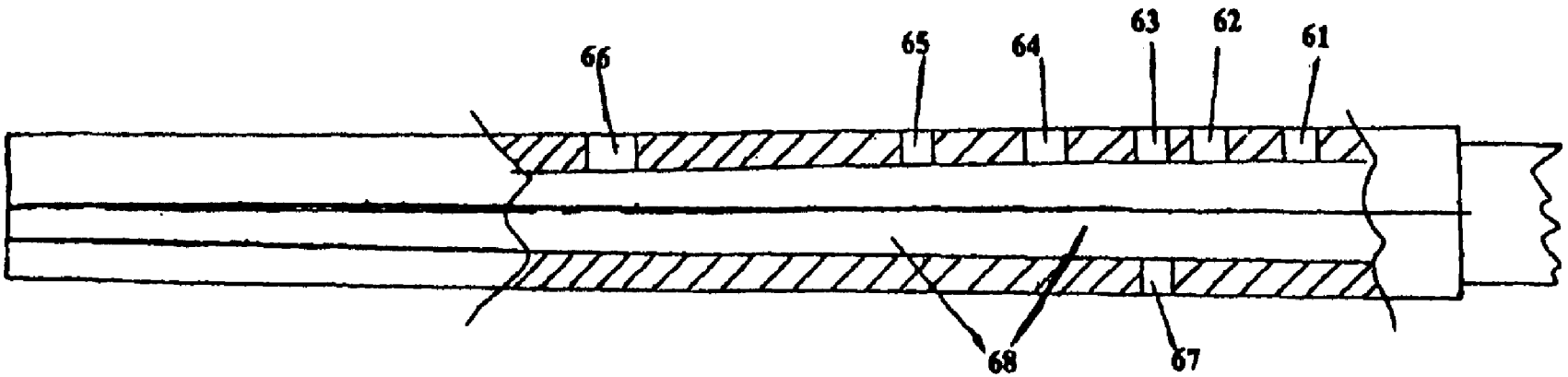
FIG. 2 is a sectional view of the instant conical piccolo body containing a C sharp trill tone hole opening.
Figure 3:
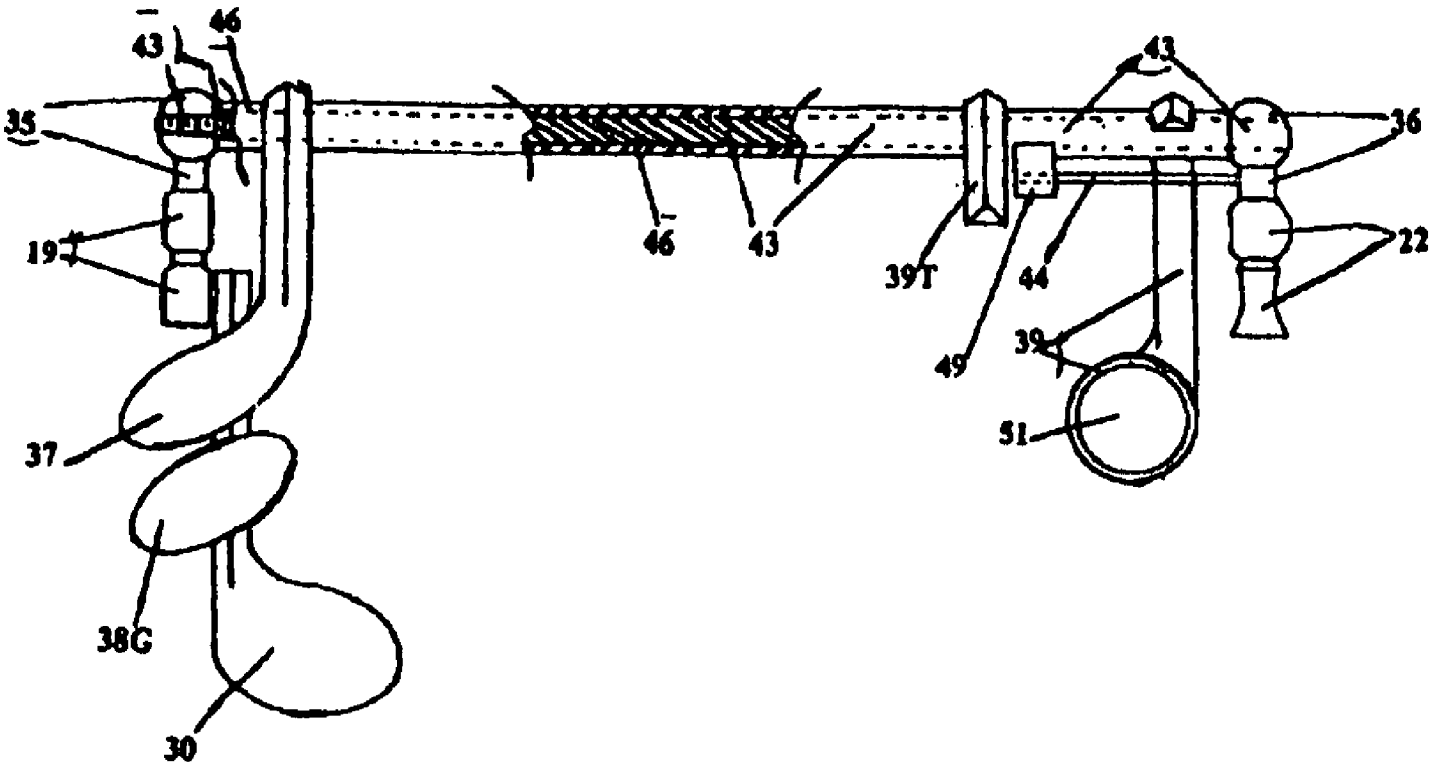
FIG. 3 is a top view of the instant conical piccolo mechanism and particularly the G sharp touch piece and a C sharp trill key which is connected by an axle which is mounted to the conical piccolo mechanism on the conical piccolo on the F sharp post and the upper C sharp post.
Figure 4:
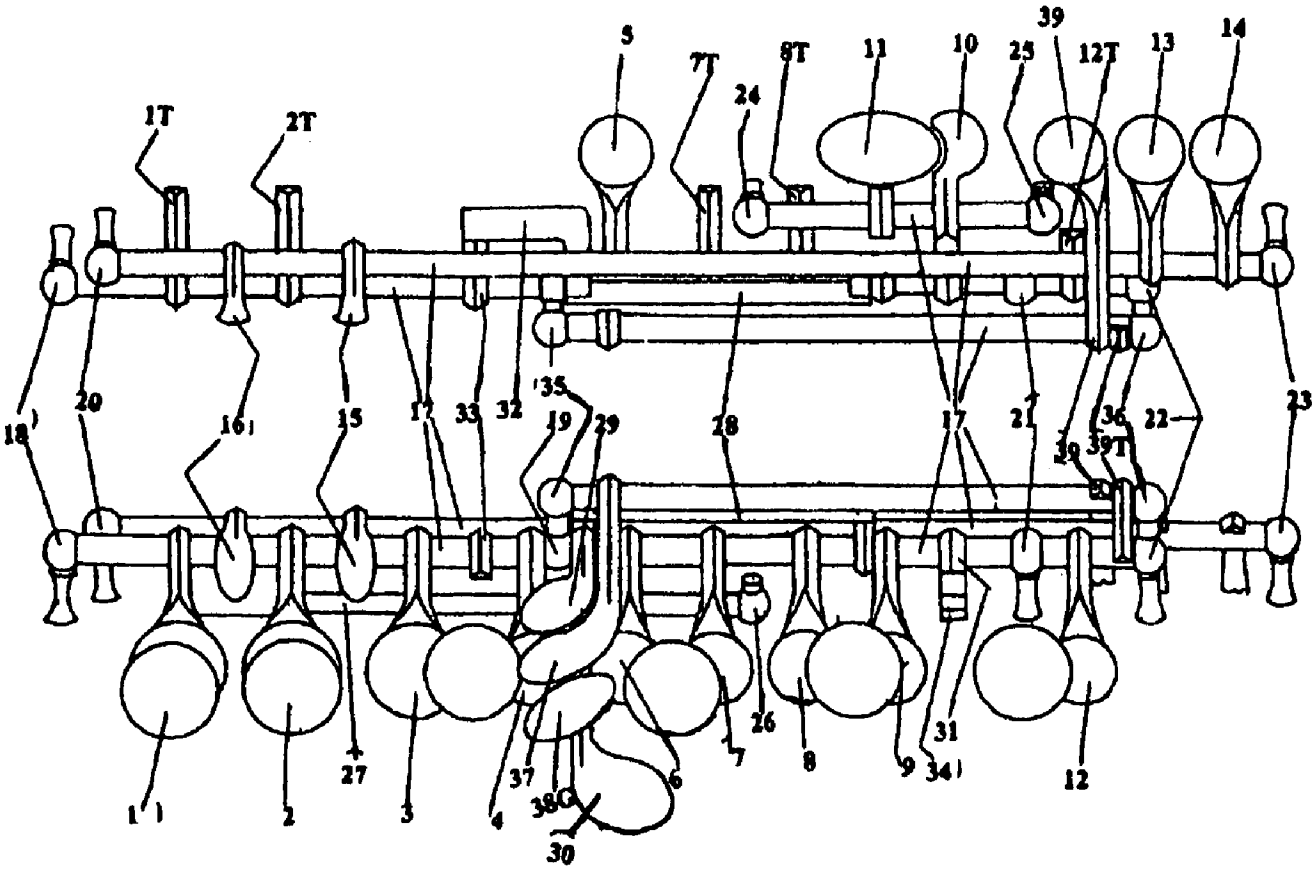
FIG. 4 is a top view of the instant conical piccolo mechanism and particularly a post mounted C sharp trill key and a G sharp trill touch piece.

FIGS. 2, 3 and 4 illustrate one embodiment of the subject invention. Standard conical piccolos include numerous tone hole openings. FIG. 2 illustrates the sectional view of the improved conical piccolo with an additional tone hole opening. A standard conical piccolo would contain the D sharp trill tone hole opening 61, the D trill tone hole opening 62, the upper thumb tone hole opening 64, the lower thumb tone hole opening 65, the G sharp tone hole opening 66, the main line C sharp tone hole opening 67 and the conical bore 68. The improved piccolo contains the C sharp trill tone hole opening 63. This trill tone hole opening 63 provides part of the acoustic venting required for the third octave G/A trill and the other five standard trills. FIG. 3 shows the lower C sharp trill post 35 which is mounted on the F sharp post 19 found on standard conical piccolos. The upper C sharp trill post 36 is mounted on the upper C sharp post 22 found on standard conical piccolos. The C sharp trill posts 35 and 36 provide the mechanical foundation for the C sharp trill key 39. The C sharp trill post 36 has a hole in order to be fitted with C sharp trill spring 44. The lower C sharp trill post 35 has a threaded hole to accept a threaded rod, axle 43. The upper C sharp trill post 36 has a hole to accept the non-threaded section of axle 43. The C sharp trill key 39 is attached to a pad 51, which seals the C sharp trill tone hole opening 63 when the key is in the at-rest (closed) position.

FIG. 3 illustrates the pad 51 on the underside of the C sharp trill key 39; however, pad 51 is not readily visible when the C sharp trill key 39 is mounted on the body of the piccolo. The C sharp trill key tail 39T provides a limit on the rotational motion of the C sharp trill key 39. The C sharp trill key 39, tail 39T and lever 37 are mounted on tubing 46 surrounding axle 43. This tubing rotates around axle 43. The C sharp trill spring 44 mounted in the upper C sharp trill post 36 is a wire spring that applies a rotational force against the C sharp trill key 39. This rotational force is applied directly against the C sharp trill spring catch 49. The C sharp trill spring catch 49 is attached to the tubing 46. The C sharp trill spring 44 keeps the C sharp trill key 39 closed and pad 51 seals off the C sharp trill tone hole opening 63. The C sharp trill lever 37 allows a user to open the C sharp trill key 39 in order to vent the C sharp trill tone hole opening 63.

Depressing the C sharp trill lever 37 causes the tubing 46 to rotate around axle 43. The C sharp trill key 39 is raised (opened) by the rotational motion of the tubing 46, thus causing the C sharp trill tone hole opening 63, to vent. Venting the C sharp trill tone hole 63 opening is necessary for the production of the six standard trills. The G sharp trill touch-piece 38G is mounted on the G sharp lever 30. Depressing the G sharp trill touch-piece 38G and the C sharp trill lever 37 simultaneously opens the C sharp trill key 39 and the G sharp key 5 simultaneously. It is necessary to open the C sharp trill key 39 and the G sharp key 5 simultaneously to achieve the G/A trill. However, opening the G sharp key 5 will prevent the production of the G sharp/F sharp trill. For the G sharp/F sharp trill, the C sharp trill key 39 must be used without opening the G sharp key 5. In summary, in this preferred embodiment the C sharp trill lever 37 and G sharp trill touch-piece 38G can be operated independently or together. Independent operation is necessary because the C sharp trill lever 37 alone is required for five of the six standard trills while both the C sharp trill lever 37 and the G sharp trill touch-piece 38G are required for the G/A trill. The G sharp trill touch-piece 38G is prohibited from use during the F sharp/G sharp trill.

Figure 5:
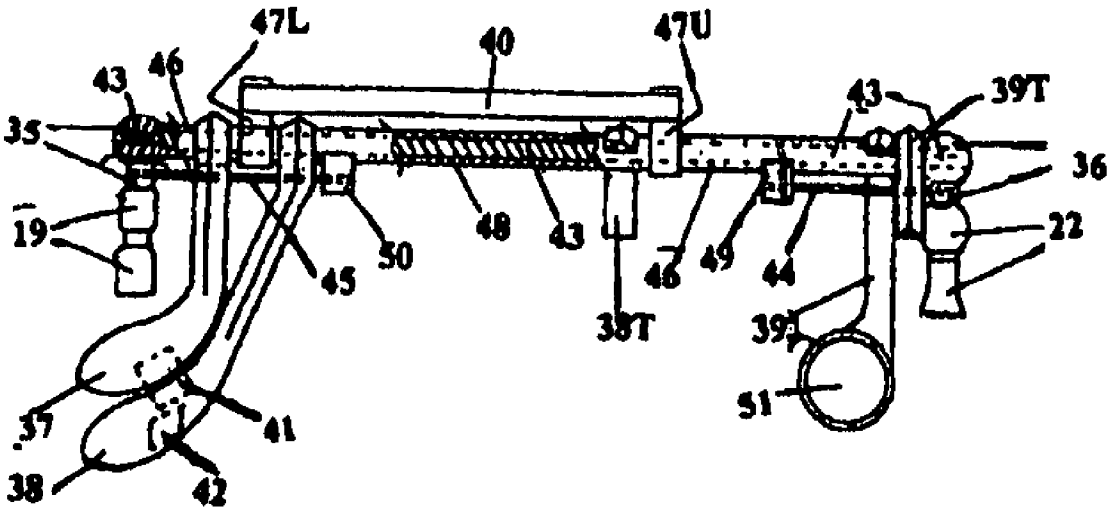
FIG. 5 is a top view of the instant conical piccolo mechanism and particularly a G sharp trill lever and a C sharp trill key which is connected by an axle which is mounted to a conical piccolo mechanism on a conical piccolo on the F sharp post and the upper C sharp post.
Figure 6:
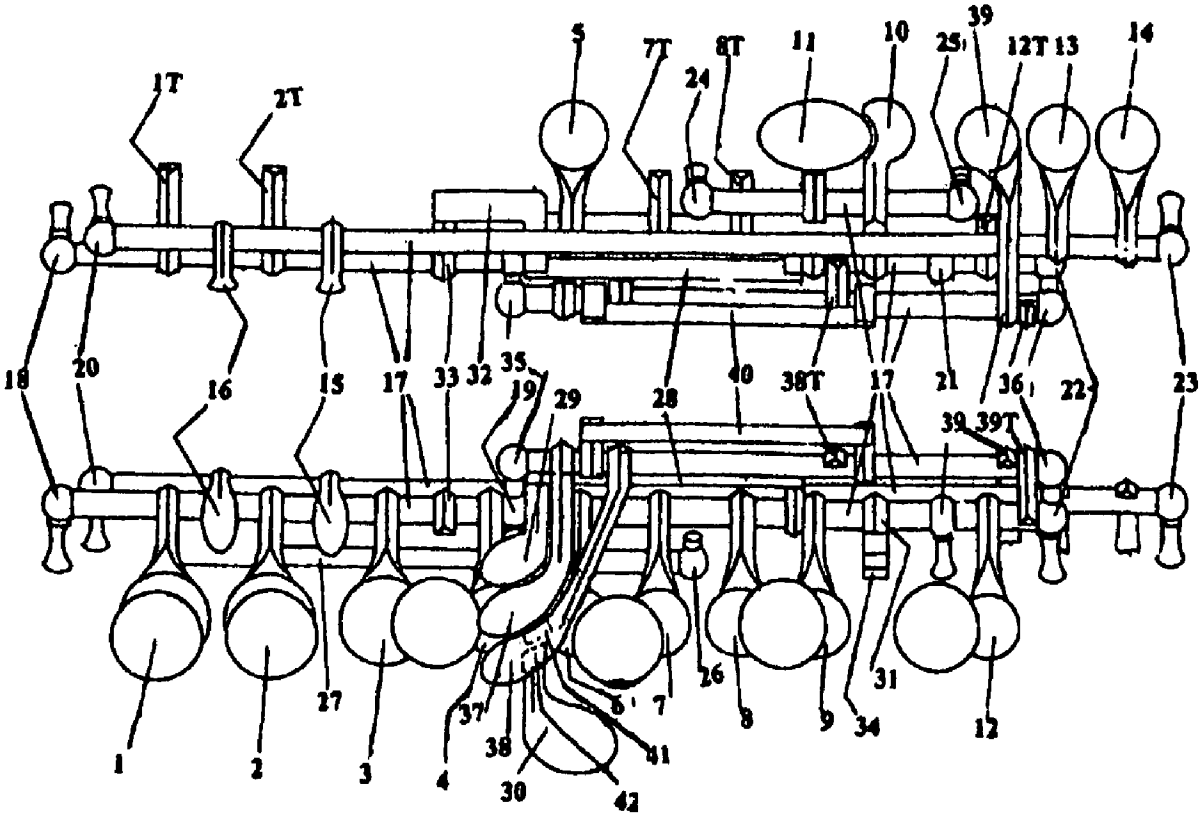
FIG. 6 is a top view of the instant conical piccolo mechanism containing a post mounted C sharp trill key, a G sharp trill lever, a G sharp trill tail, a C sharp trill bridge, a C sharp trill clutch plate, and a G sharp lever underside boss.

An additional benefit of this embodiment is that the independent G sharp trill touch-piece 38G allows a user to more easily play the trill for G to G sharp in the first two octaves. The trill can be played with the first finger right hand rather than the fourth finger of the left hand. FIGS. 2, 5 and 6 illustrate another embodiment of the subject invention. FIG. 2 illustrates the sectional view of the improved conical piccolo with an additional tone hole opening. A standard conical piccolo would contain the D sharp trill tone hole opening 61, the D trill tone hole opening 62, the upper thumb tone hole opening 64, the lower thumb tone hole opening 65, the G sharp tone hole opening 66, the main line C sharp tone hole opening 67 and the conical bore 68. The improved piccolo contains the C sharp trill tone hole opening 63. This trill tone hole opening 63 provides part of the acoustic venting required for the third octave G/A trill and the other five standard trills. FIG. 6 shows the lower C sharp trill post 35 which is mounted on the F sharp post 19 found on standard conical piccolos.

The upper C sharp trill post 36 is mounted on the upper C sharp post 22 found on standard conical piccolos. The C sharp trill posts 35 and 36 provide the mechanical foundation for the C sharp trill key 39. The lower C sharp trill post 35 has a threaded hole to accept a threaded rod, axle 43. The upper C sharp trill post 36 has a hole to accept the non-threaded section of axle 43. The C sharp trill key 39 is attached to a pad 51, which seals the C sharp trill tone hole opening 63 when the key is in the at-rest (closed) position. The C sharp trill key tail 39T provides a limit on the rotational motion of the C sharp trill key 39. The C sharp trill key 39, tail 39T and lever 37 are mounted on tubing 46 surrounding axle 43. This tubing 46 rotates around axle 43. The G sharp trill lever 38 and tail 38T are mounted on tubing 48 surrounding axle 43. This tubing 48 rotates around axle 43. The G sharp trill spring 45 is mounted in Lower C sharp trill post 35. The C sharp trill spring 44 is mounted in the upper C sharp trill post 36. These are wire springs that apply a rotational force against the C sharp trill key 39 and the G sharp trill lever 38. The rotational force is applied directly against C sharp trill spring catch 49 and G sharp trill spring catch 50 respectively.

Further, the spring catches are attached to the tubing 46 and 48. The C sharp trill spring 44 keeps the C sharp trill key 39 closed and sealing off the C sharp trill tone hole opening 63. The G sharp trill spring 45 raises the G sharp trill lever 38 away from the C sharp trill lever 37. The limit on the rotation of the G sharp trill lever 38 is the G sharp trill tail 38T. The C sharp trill lever 37 allows the player to open C sharp trill key 39 in order to vent the C sharp trill tone hole opening 63. Depressing the C sharp trill lever 37 causes the tubing 46 and the C sharp trill bridge 40 to rotate around the C sharp axle 43. The C sharp trill key 39 is raised (opened) by the rotational motion of the tubing 46, thus causing the C sharp trill tone hole opening 63, to vent. A C sharp trill bridge 40 is a bar that is mounted over a gap in the G sharp trill tubing 48 and is attached to tubing 46 by means of hangers 47L and 47U and provides a means of transferring the motion from the C sharp trill lever 37 to the C sharp trill key 39 while providing space for the G sharp trill tubing 48 to be mounted on the C sharp axle 43.

The G sharp trill lever 38 connects with the C sharp trill lever 37 and the G sharp lever 30. By depressing the G sharp trill lever 38, a user is able to open simultaneously the C sharp trill key 39 and the G sharp key 5. It is necessary for the user to open both the C sharp trill key 37 and the G sharp key 5 simultaneously to achieve the G/A trill. However, opening the G sharp key 5 will prevent the production of the G sharp/F sharp trill. For this trill, the C sharp trill key 37 must be used without opening the G sharp key 5. The C sharp trill lever clutch plate 41 is attached to the underside of C sharp trill lever 37 and extends under the G sharp trill lever 38. When the G sharp trill lever 38 is depressed thereby opening the G sharp key 5, it contacts the C sharp trill lever clutch plate 41 and causes the C sharp trill lever 37 to depress. When the G sharp trill lever 38 is depressed, the G sharp lever underside boss 42 attached to the underside of the G sharp trill lever 38 contacts the G sharp trill lever 38 and causes it to depress, thereby opening G sharp key 5.

In summary, the C sharp trill lever 37 can be operated independently or in conjunction with G sharp trill lever 38. This is necessary because the C sharp trill lever 37 alone is required for five of the six standard trills while both the C sharp trill lever 37 and the G sharp trill lever 38 are required for the G/A trill. The G sharp trill lever 38 is prohibited for use during the F sharp/G sharp trill.

Figure 7:
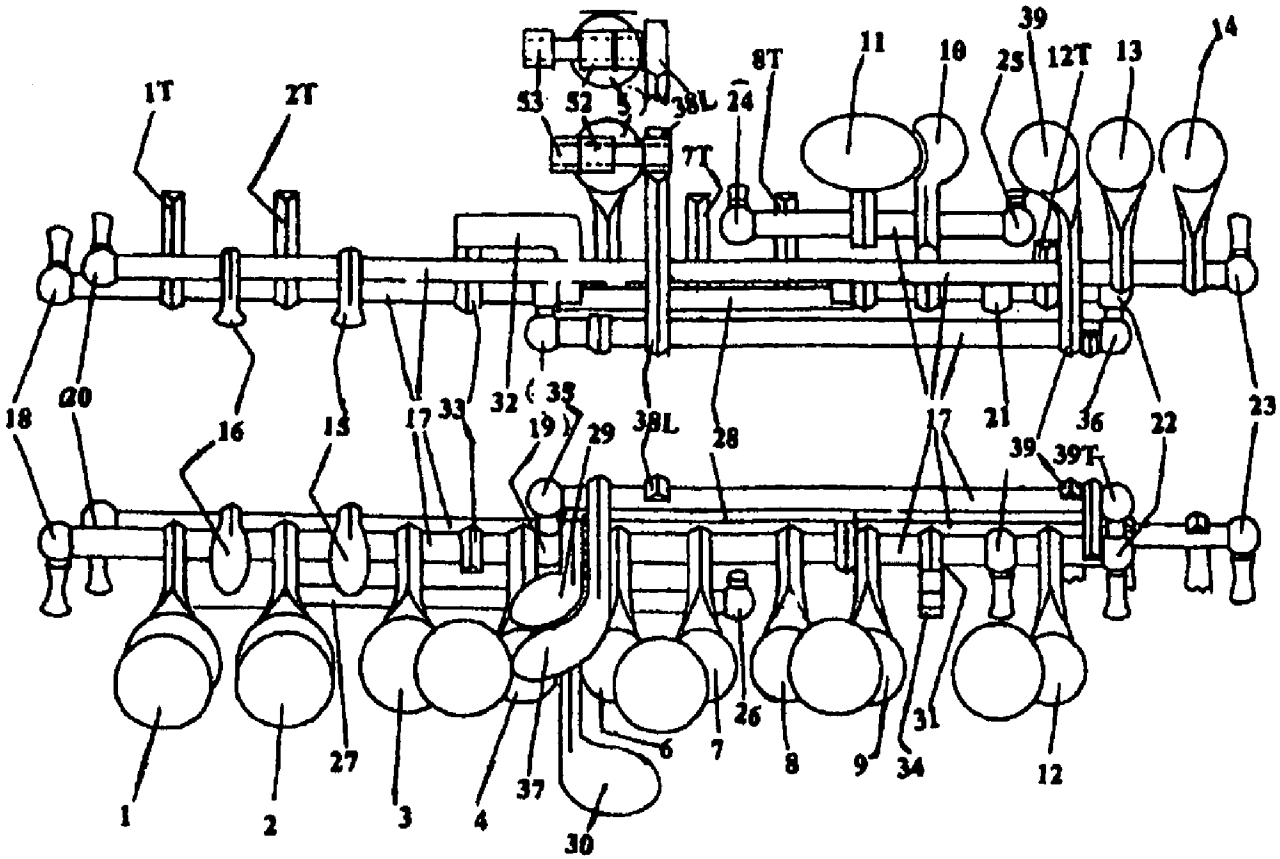
FIG. 7 is a top view of one embodiment of the instant conical piccolo mechanism containing a post mounted C sharp trill key, a G sharp trill link, a G sharp key barrel, and a G sharp key pin.

Additionally, FIGS. 7, 5 and 2 illustrate another embodiment of the subject invention. In this embodiment the G sharp trill lever 38 of previous embodiments is eliminated and instead a link between the G sharp key 5 and the C sharp trill tubing 46 is added. Using this embodiment, a user would need to couple the G sharp key 5 to the G sharp trill link 38L for the purpose of playing the G/A trill. This would be accomplished by sliding G sharp key pin 53 through G sharp key barrel 52 so that the G sharp key pin 53 contacts G sharp trill link 38L. When the C sharp trill key 39 is depressed, its rotation would cause G sharp trill link 38L to rise which would then in turn open the G sharp key 5. To play the F sharp/G sharp trill, the player would be required to de-couple the G sharp key 5 from the G sharp trill link 38L. This would be accomplished by sliding G sharp key pin 53 through G sharp key barrel 52 so that the G sharp key pin 53 clears the G sharp trill link 38L.

Figure 8:
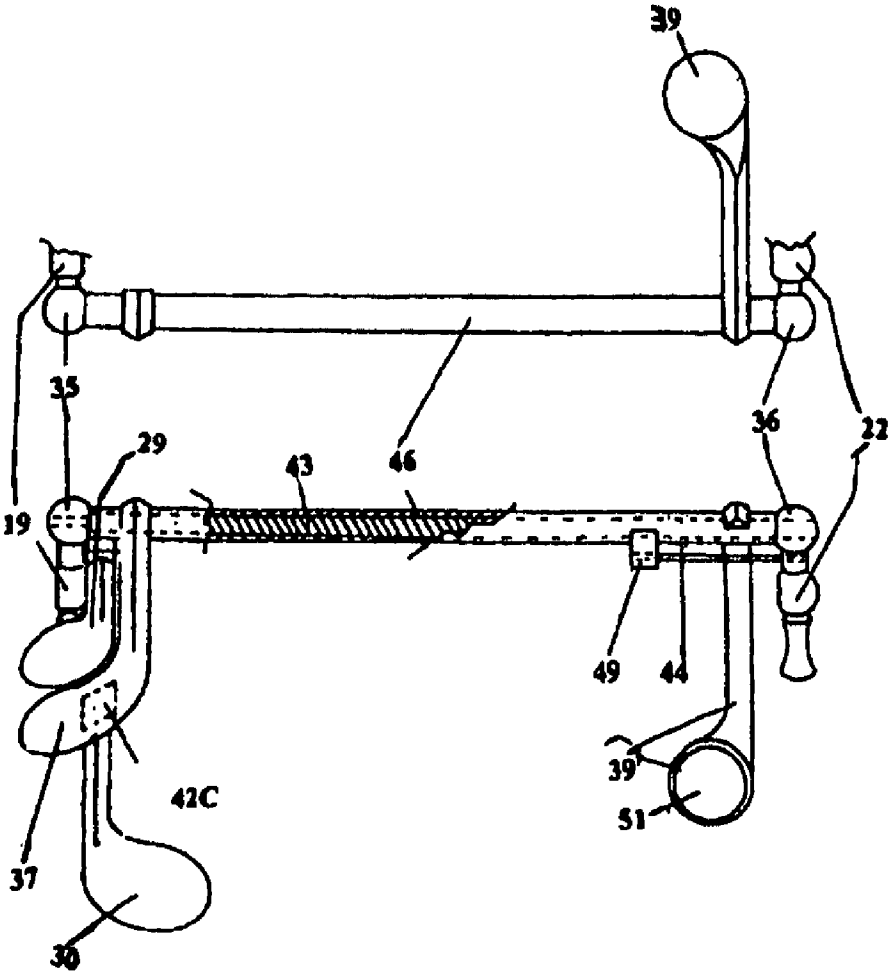
FIG. 8 is a top view of a conical piccolo mechanism containing a post mounted C sharp trill key and a C sharp lever underside boss.
Figure 9:
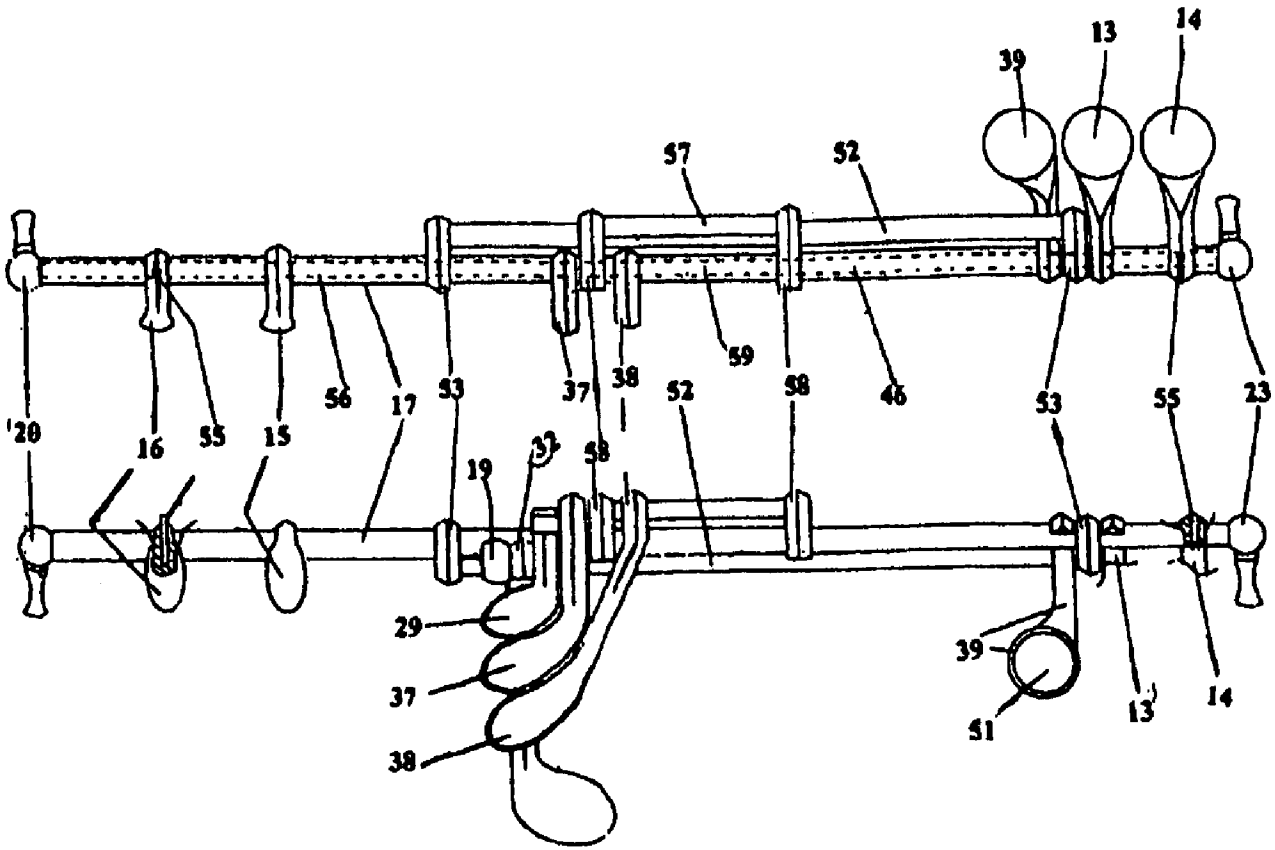
FIG. 9 is a top view of the instant conical piccolo mechanism containing a C sharp trill key mounted on the D and D sharp trill axle further containing a G sharp trill lever, a G sharp trill tail, a C sharp trill bridge, a C sharp trill clutch plate, a G sharp lever underside boss and a C sharp trill bridge.
Figure 10:
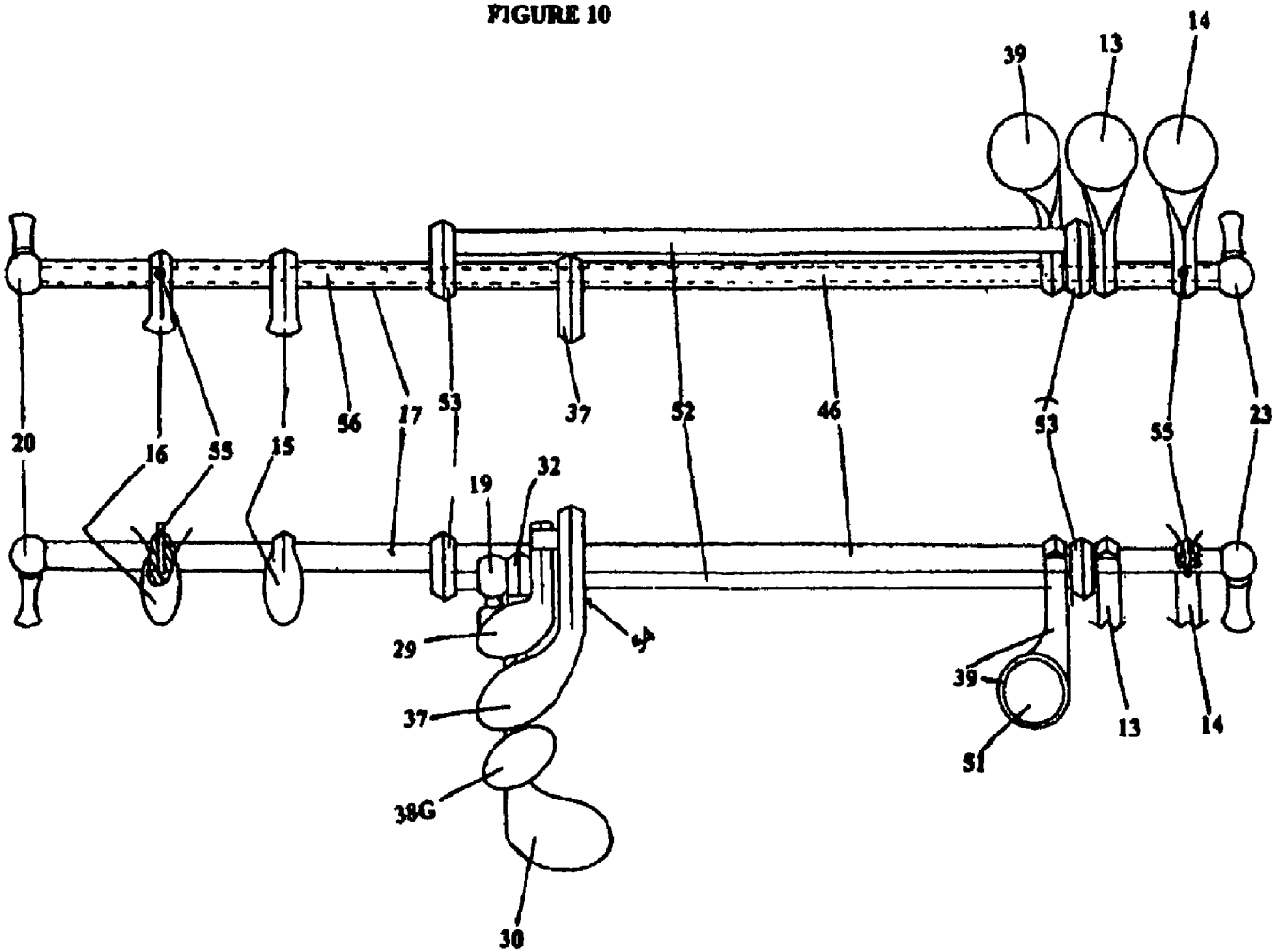
FIG. 10 is a top view of the instant conical piccolo mechanism containing a C sharp trill key mounted on the D and D sharp trill axle further containing a G sharp trill touch piece and a D trill bridge.

FIGS. 8, 5 and 2 illustrate another embodiment of the subject invention. In this embodiment, a C sharp lever underside boss 42C is mounted under the C sharp trill lever 37 that contacts the G sharp lever 30. When the C sharp trill lever 37 is depressed, it contacts and depresses the G sharp lever 30, causing the G sharp key 5 to open. FIGS. 9-12 illustrate additional embodiments of the subject invention. In these embodiments, the C sharp trill key 39 is not mounted on separate posts as it was in previous embodiments. However, the C sharp trill key 39 is mounted on the D/D sharp axle 56. Essentially, the C sharp trill key 39 is spliced into the tubing 17. The two parts of the D trill are then reconnected by means of a D trill bridge 52.

Figure 13:
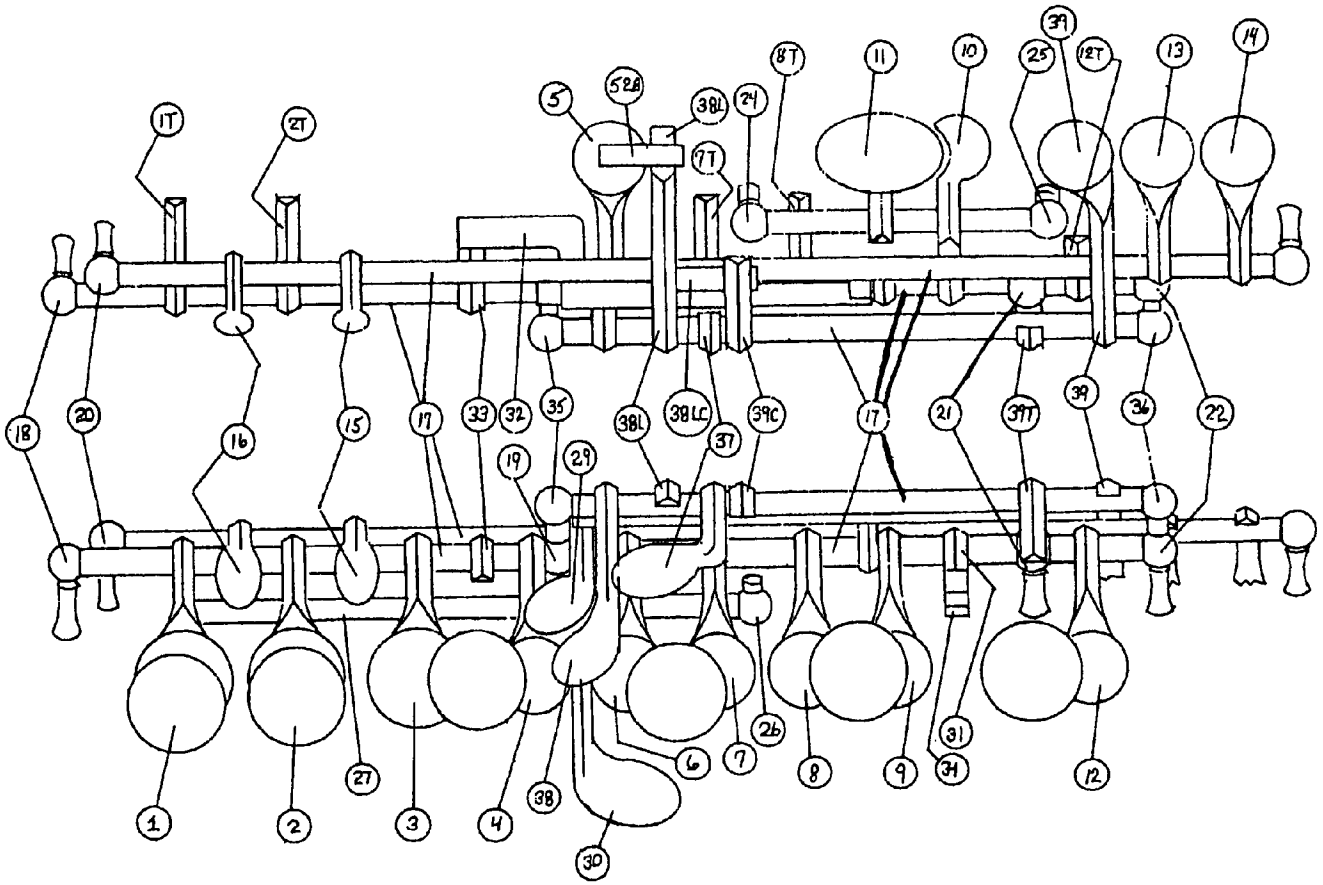
FIG. 13 is a top view of the 158A embodiment of the instant conical piccolo mechanism design as illustrated placed within the overall piccolo key system.
Figure 14:
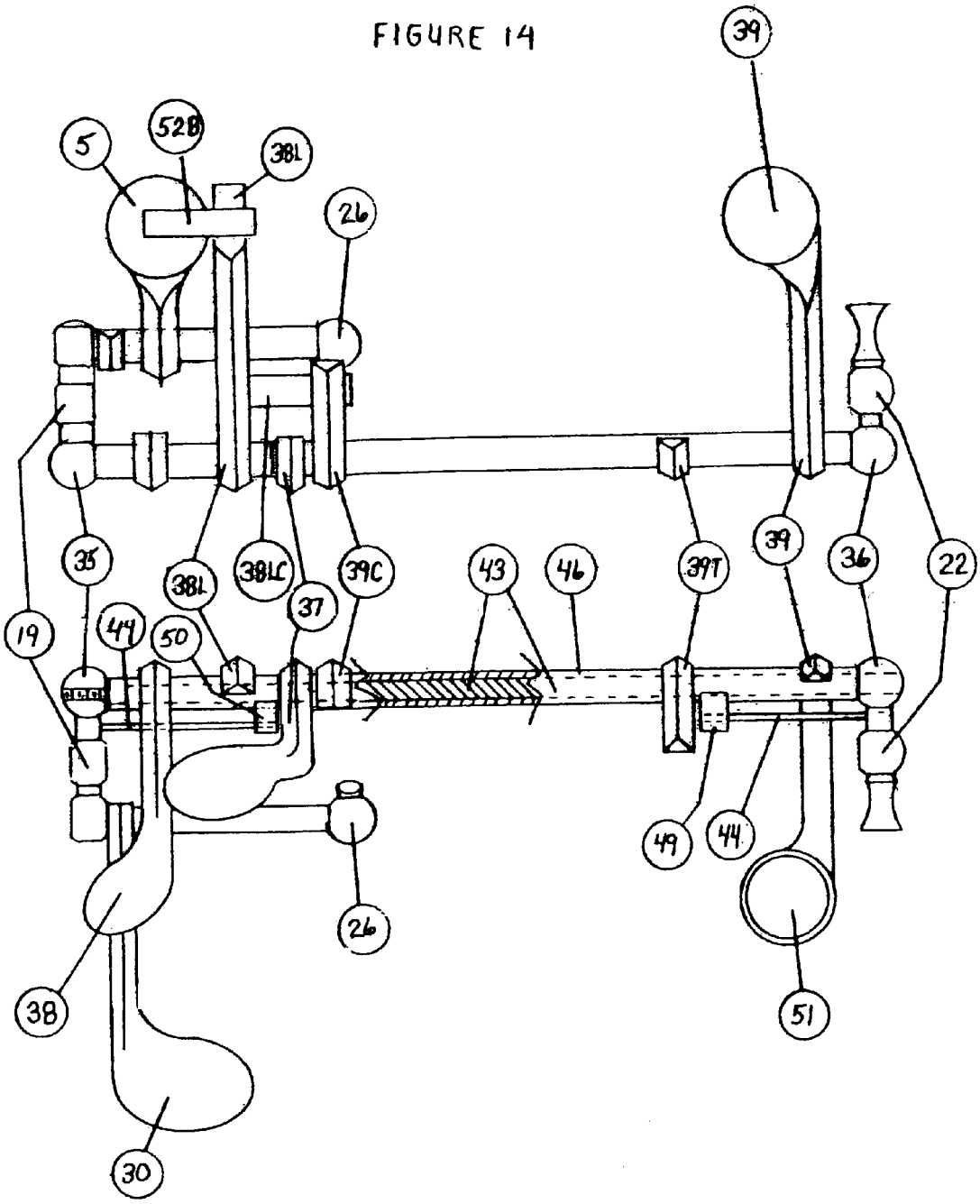
FIG. 14 is a top view of the 158A embodiment the instant conical piccolo mechanism design, illustrating an isolation of the components of the 158A embodiment including the C sharp trill key, the C sharp trill tail, a C sharp trill lever, the C sharp trill clutch. Also illustrated is the G sharp trill key, consisting of a G sharp trill lever, the G sharp trill link, the G sharp trill link clutch, and the G sharp key connection bar which is mounted on the G sharp key.

FIG. 13 illustrates a further embodiment, an instrument deemed the 158A design. In the instant embodiment, there exist two key elements of design 158A. FIG. 14 further illustrates an isolated view of the components of the 158A embodiment. The first element comprises a G sharp trill key which drives the C sharp trill by means of a clutch. Although the clutch was utilized in prior embodiments of the instant application, as seen in FIGS. 5 and 6, for the 158A embodiment, is now moved to a new position to allow for the 158A configuration. The clutch continues to perform substantially the same function.

Figure 11:
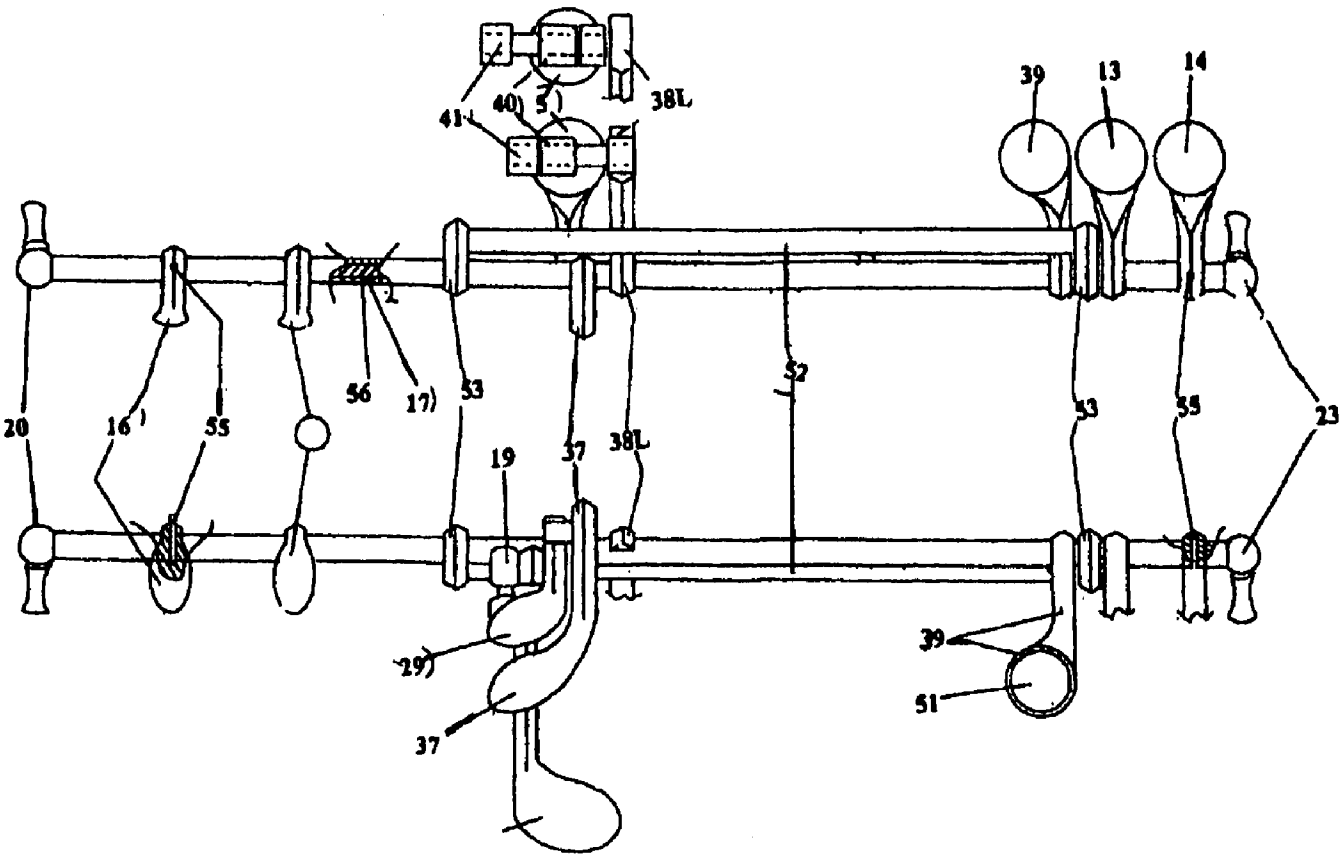
FIG. 11 is a top view of the instant conical piccolo mechanism containing a C sharp trill key mounted on the D and D sharp trill axle further containing a G sharp trill link, a G sharp key barrel, a G sharp key pin and a D trill bridge.
Figure 12:
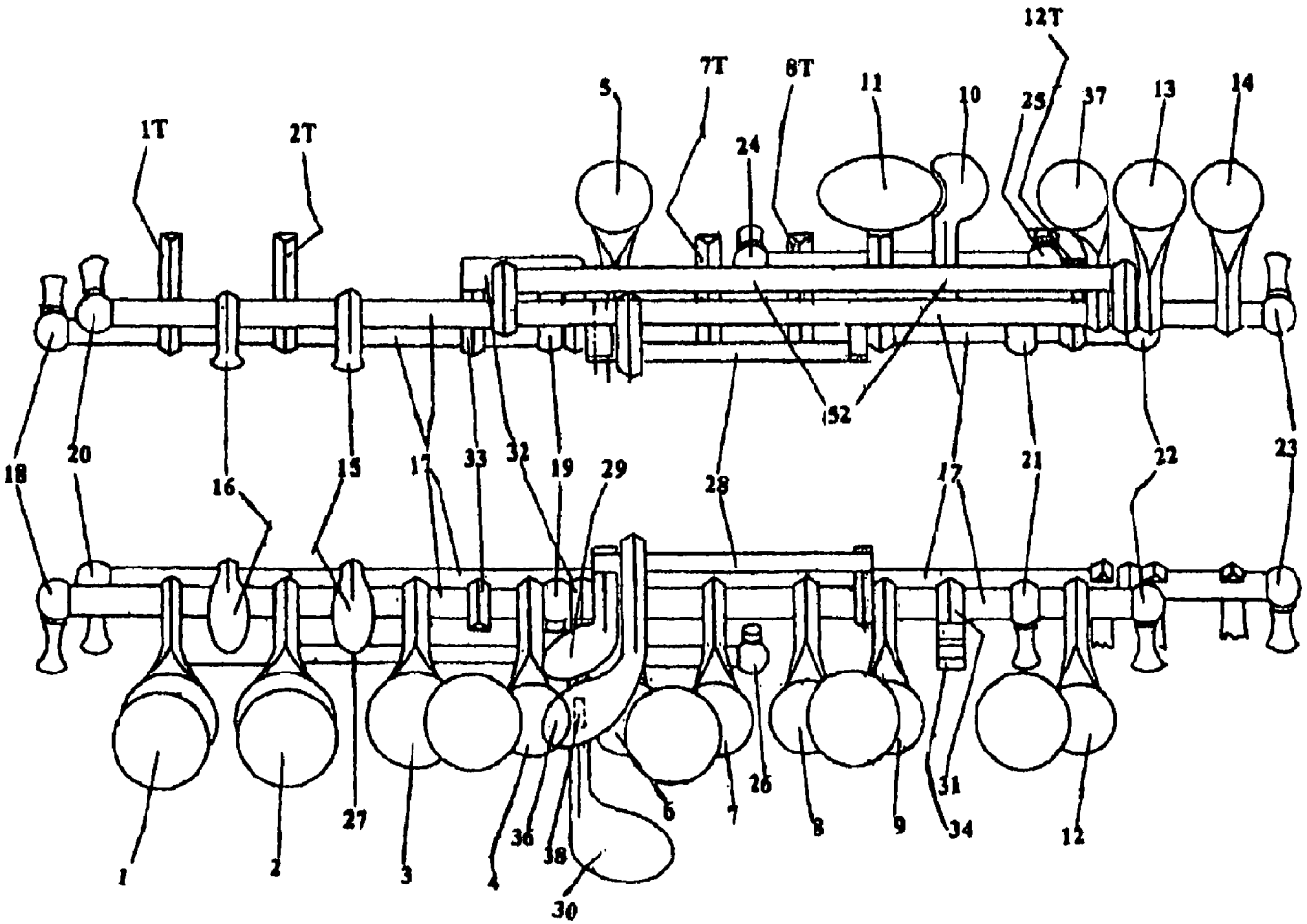
FIG. 12 is a top view of the instant conical piccolo mechanism containing a C sharp trill key mounted on the D and D sharp trill axle further containing a C sharp trill boss and a D trill bridge.

The second element is that the G sharp trill key opens the G sharp key by means of a link that is part of the G sharp trill key and a bar that is mounted on the G sharp key. Although the herein discussed link and bar were utilized in prior embodiments of the instant application, as illustrated in FIGS. 7 and 11, whereas, the bar was movable between the engaged and disengaged positions in prior embodiments, in the 158A, the bar does not move, but instead is remains fixed in the engaged position.

Further exploring the above described 158A embodiment, the C sharp trill mechanism shown on drawing 158A consists of two additional keys and one additional tone hole beyond the typical arrangement as found in the embodiment described in FIG. 1 herein. The two additional keys comprise C sharp trill key 39 and G sharp trill lever 38. These additional keys, as seen in differing configurations, are also found on FIGS. 5, 6, 8, 9 and 12. The additional tone hole 63 can be found on FIG. 2.

Design 158A thus contains a C sharp trill key, consisting of a C sharp trill key 39, a C sharp trill tail 39T now moved to a new location but with the same function, a C sharp trill lever 37 and C sharp trill clutch 39C. Design 158A also contains a G sharp trill key, consisting of a G sharp trill lever 38, a G sharp trill link 38L, a G sharp trill link clutch 38LC, and a G sharp key connection bar 52B which is mounted on the G sharp key 5.

Illustrating the method of operation, the player trills the C sharp trill key for the six trills produced by the cylindrical flute with the c sharp trill key excepting one trill. The player trills the G sharp trill lever for only one trill (the high G to A trill). The C sharp trill key operates independently of the G sharp trill key. The G sharp trill key is connected to the C sharp trill key via the G sharp trill link clutch. When the G sharp trill key is depressed, the G sharp trill link rises and its clutch engages the C sharp trill clutch, causing the C sharp trill key to open.

The link between the G sharp trill lever 38 and the C sharp trill lever 37 is illustrated as follows: In design 158A, the C sharp trill key is activated either directly (when the player depresses C sharp trill lever 37 or indirectly (when the player depresses G sharp trill lever 38). The G sharp trill lever drives the C sharp trill lever by means of G sharp trill link clutch 38LC connecting with C sharp trill clutch 39C.

In prior embodiments of the instant application, as illustrated in FIGS. 5 and 6, the C sharp trill key is activated either directly (when the player depresses C sharp trill lever 37) or indirectly (when the player depresses G sharp trill lever 38). The G sharp trill lever drives the C sharp trill lever by means of C sharp trill clutch plate 41. Thus, in both design 158A and FIGS. 5 and 6, the G sharp trill lever drives the C sharp trill lever by means of a mechanical link, deemed the clutch.

The link between the G sharp trill lever 38 and the G sharp key 5 is illustrated as follows: In design 158A, the G sharp trill lever 38 is activated (depressed) to open the G sharp key 5. The G sharp trill lever 38 connects with the G sharp key 5 via the G sharp trill link 38L and G sharp key connection bar 52B, which is mounted on the G sharp key 5.

While several variations of the present invention have been illustrated by way of example in preferred or particular embodiments, it is apparent that further embodiments could be developed within the spirit and scope of the present invention, or the inventive concept thereof. However, it is to be expressly understood that such modifications and adaptations are within the spirit and scope of the present invention, and are inclusive, but not limited to the following appended claims as set forth.

We claim:

1. An improved conical piccolo comprising:

an additional tone hole opening;

an axle;

means for attaching the axle to the conical piccolo;

wherein the axle further comprises an external cover of tubing; wherein the tubing rotates around the axle;

a trill key attached at a first end to the tubing;

a trill key pad attached to a second end of the trill key;

means for applying a first rotational force to the trill key wherein the trill key pad seals the additional tone hole opening;

means for a user to apply a second rotational force wherein the trill key rotates on the tubing away from the additional tone opening wherein the trill key pad no longer seals the additional tone hole opening;

a C sharp trill mechanism; and, wherein a portion of said mechanism is disposed substantially within a midsection and a portion of said mechanism is disposed at second end of said piccolo.

2. The improved conical piccolo of claim 1 wherein said C sharp trill mechanism comprises a C sharp trill key, a C sharp trill tail, a C sharp trill lever and a C sharp trill clutch wherein said trill key is disposed to drive said trill by means of a trill link clutch mechanism located substantially in a midsection of said conical piccolo.

3. The improved conical piccolo of claim 2 further comprising a C sharp trill mechanism disposed substantially within a midsection of said piccolo.

4. The improved conical piccolo of claim 3 wherein a user trills the second sharp trill lever for only the high G to A trill.

5. The improved conical piccolo of claim 3 wherein said second C sharp trill mechanism comprises a second sharp trill key, a second sharp trill lever, a second sharp trill link and a second sharp trill clutch and a sharp key connection bar mounted on said second sharp key.

6. The improved conical piccolo of claim 5 wherein said second sharp trill key drives said first trill key.

7. The improved conical piccolo of claim 5 wherein said sharp key connection bar is fixed in position.

8. An improved piccolo mechanism comprising:

an additional tone hole opening;

a first post attached to the F sharp post;

a second post attached to the upper C sharp post;

an axle attached at a first end to the first post and attached at a second end to the second post;

wherein the axle further comprises an external cover of tubing, wherein the tubing rotates around the axle;

a trill key attached at a first end to the tubing proximal to the second post;

a trill key pad attached to a second end of the trill key;

a trill key tail attached at a first end to the tubing proximal to the second post;

a trill lever attached at a first end to the tubing proximal to the first post;

a spring catch attached to the tubing;

a wire spring attached at a first end to the second post and attached at a second end to the spring catch;

wherein the wire spring applies rotational force to the trill key and the spring catch in opposing directions wherein the trill key pad seals the additional tone hole opening, wherein depressing a second end of the trill lever rotates the tubing around the axle and opposes the rotational force applied to the trill key wherein the trill key rotates on the tubing away from the additional tone hole opening wherein the trill key pad no longer seals the tone hole opening; and, a C sharp trill mechanism comprising:

a C sharp trill key comprising: a C sharp trill key, a C sharp trill tail, a C sharp trill lever and a C sharp trill clutch; and, a G sharp trill key mechanism comprising: a G sharp trill lever, a G sharp trill link, a G sharp trill link clutch, and a G sharp key connection bar which is mounted on a G sharp key.

9. The improved piccolo mechanism of claim 8 wherein upon activation of said C sharp trill mechanism and said G sharp trill mechanism, a user achieves two additional skills.

10. The improved piccolo mechanism of claim 9 wherein said two additional trills comprise a first octave c to d trill and a second octave c to d trill.

11. An improved conical piccolo apparatus comprising:

an additional tone hole opening;

an axle;

means for attaching the axle to the conical piccolo;

wherein the axle further comprises an external cover of tubing; wherein the tubing rotates around the axle;

a first trill key attached to a first end of the tubing;

a trill key pad attached to a second end of the first trill key;

means for applying a first rotational force to the first trill key wherein the trill key pad seals the additional tone hole opening; and means for a user to apply a second rotational force wherein the trill key rotates on the tubing away from the additional tone opening wherein the trill key pad no longer seals the additional tone hole opening; and, a clutch mechanism wherein actuation of said clutch mechanism allows said first trill key to drive a second trill key.

12. The improved conical piccolo apparatus of claim 11 further comprising a link attached to the second trill key and bar, wherein the bar is attached to said link at a first end and the bar is attached to a non trill key at a second end, and wherein upon actuation of the second trill key, the non trill key opens.

* * * * *

UNITED STATES PATENT AND TRADEMARK OFFICE

CERTIFICATE OF CORRECTION

PATENT NO. : 7,589,268 B2
APPLICATION NO. : 12/070700
DATED : September 15, 2009
INVENTOR(S) : James J. Keefe et al.

It is certified that error appears in the above-identified patent and that said Letters Patent is hereby corrected as shown below:

Title Pg, Item (76) Inventors:

Please change the spelling of inventor "Janet D. Kinmouth" to the correct spelling of "Janet D. Kinmonth"

Signed and Sealed this

Twenty-first Day of December, 2010

David J. Kappos

David J. Kappos
*Director of the United States Patent and Trademark Office*